US007907045B2

(12) United States Patent
Ishikawa et al.

(10) Patent No.: US 7,907,045 B2
(45) Date of Patent: Mar. 15, 2011

(54) HOISTING MACHINE

(75) Inventors: Kazumitsu Ishikawa, Yamanashi (JP); Kazuhiro Nishikawa, Yamanashi (JP)

(73) Assignee: Kito Corporation, Yamanashi (JP)

( * ) Notice: Subject to any disclaimer, the term of this patent is extended or adjusted under 35 U.S.C. 154(b) by 0 days.

(21) Appl. No.: 12/532,020

(22) PCT Filed: Mar. 4, 2008

(86) PCT No.: PCT/JP2008/053880

§ 371 (c)(1),
(2), (4) Date: Sep. 18, 2009

(87) PCT Pub. No.: WO2008/114608

PCT Pub. Date: Sep. 25, 2008

(65) Prior Publication Data

US 2010/0127818 A1 May 27, 2010

(30) Foreign Application Priority Data

Mar. 19, 2007 (JP) ..... 2007-071502
Mar. 19, 2007 (JP) ..... 2007-071503

(51) Int. Cl.
*H01C 1/08* (2006.01)

(52) U.S. Cl. ..... 338/51; 187/305; 254/360

(58) Field of Classification Search ..... 338/51, 338/98, 197–198, 226, 322, 333, 334; 187/305, 187/286; 254/360, 372
See application file for complete search history.

(56) References Cited

U.S. PATENT DOCUMENTS 3,769,480 A * 10/1973 Lee ..... 338/76
3,784,165 A * 1/1974 Pruitt ..... 254/342
4,140,010 A * 2/1979 Kulpmann et al. ..... 73/862.56
6,427,982 B1 * 8/2002 Sugimachi ..... 254/360
6,478,117 B2 * 11/2002 Swaybill ..... 187/305
7,781,997 B2 * 8/2010 Kallioniemi et al. ..... 318/379

FOREIGN PATENT DOCUMENTS

JP 5-65988 U 8/1993
JP 5-39603 Y2 10/1993
JP 7-53186 A 2/1995
JP 08-91784 A 4/1996
JP 08-133685 A 5/1996
JP 10-32101 A 2/1998

OTHER PUBLICATIONS

International Preliminary Report on Patentability (Form PCT/IPEA/409) for International application No. PCT/JP2008/053880.

* cited by examiner

*Primary Examiner* — Kyung Lee
(74) *Attorney, Agent, or Firm* — Westerman, Hattori, Daniels & Adrian, LLP

(57) ABSTRACT

A hoisting machine having a load hoisting motor and a speed reduction mechanism and driving the load hoisting motor with an inverter 12 incorporated in the hoisting machine main body is provided with a heat dissipation means that dissipates heat generated from the inverter 12 to a speed reduction mechanism casing 15 that houses the speed reduction mechanism. The heat dissipation means is a means for attaching the inverter 12 directly to the speed reduction mechanism casing 15 in close contact therewith through surface contact at least a part of the inverter 12.

5 Claims, 14 Drawing Sheets

(a)

(b)

HOISTING MACHINE

TECHNICAL FIELD

The present invention relates to hoisting machines, such as electric chain blocks and electric hoists, which drive a load hoisting motor with an inverter incorporated therein. More particularly, the present invention relates to a hoisting machine capable of efficiently dissipating heat generated from the inverter into the surrounding air and also capable of efficiently dissipating, into the surrounding air, heat generated from a regenerative braking resistor when supplied with a regenerative electric current generated during regenerative braking of the load hoisting motor, and hence capable of performing high-frequency operation.

BACKGROUND ART

There are hoisting machines, such as electric chain blocks and electric hoists, which use as a load hoisting motor an inverter-driven motor that is driven by an inverter incorporated in the hoisting machine main body. In such a hoisting machine, when the temperature of the inverter exceeds a predetermined set temperature, the inverter is tripped (shut off) to stop the operation of the hoisting machine from the viewpoint of safety. When a hoisting machine is operated at high frequency, i.e. when the operating time of the hoisting machine accounts for 60% or more of the sum total (100%) of the operating time and down time, a large amount of heat is generated from the inverter, and the heat undesirably stays in a control box housing the inverter. When the temperature in the control box exceeds the above-described predetermined set temperature (e.g. 100° C.), the inverter is tripped to stop the operation of the hoisting machine.

FIG. 1 is a sectional plan view showing the internal structure of a control box of a conventional electric chain block of the type described above. A control box 100 houses an inverter 102, an electromagnetic switch 103 and a transformer 104 that are mounted on a steel panel 101. When the electric chain block is operated at high frequency, a large amount of heat is generated from the inverter 102 as stated above. Because the panel 101 is made of steel, it is inferior in thermal conductivity to aluminum or other similar material. The panel 101 is also inferior in heat dissipation properties because it is thin in thickness. Therefore, the heat generated from the inverter 102 cannot escape but undesirably stays in the control box 100, causing the temperature to rise. As a result, the inverter 102 is tripped. It should be noted that reference numeral 105 in FIG. 1 denotes a speed reduction mechanism casing that houses a speed reduction mechanism (detailed later) of the electric chain block.

As a countermeasure against this problem, there is a method wherein, as shown in FIG. 2, the control box 100 is made of aluminum, and the inverter 102 is attached to the inner wall surface of the control box 100. With this method, the control box 100 is made of an aluminum material of good thermal conductivity, and the outer wall surface of the control box 100 is exposed to the surrounding air. Therefore, it is possible to expect that heat generated from the inverter 102 can be effectively dissipated. With this structure, however, wiring and maintenance are troublesome because the components other than the inverter 102, i.e. the electromagnetic switch 103 and the transformer 104, are attached to the main body side of the hoisting machine through the panel 101. Further, there is a fear that a possible impact on the control box 100 will be applied directly to the inverter 102.

Further, when the above-described hoisting machine lowers a lifted load, the load hoisting motor functions as a generator, and a regenerative electric current thus generated is passed through a regenerative braking resistor to consume it as heat, thereby regeneratively braking the load hoisting motor.

FIG. 3 is a diagram showing a structural example of a conventional regenerative braking resistor of the type described above. FIG. 3(*a*) is a plan view. FIG. 3(*b*) is a front view. FIG. 3(*c*) is a right-hand side view. As illustrated in the figures, a resistor 110 comprises a rectangular parallelepiped metallic casing 111 formed from a metal plate (e.g. an aluminum plate), resistance elements of continuous length (e.g. resistance elements each comprising a nichrome wire wound around a rod member of a heat-resisting insulating material) 112 disposed in the metallic casing 111, and a heat-resisting insulating material 113 of an inorganic material filled in the space in the metallic casing 111 other than the space occupied by the resistance elements 112. The resistance elements 112 are electrically connected in series at one end of each with a lead wire 115 in the metallic casing 111. Lead wires 114 connected to the other ends of the resistance elements 112 extend from an end of the metallic casing 111.

In the case of using as a regenerative braking resistor a resistor having resistance elements 112 disposed in a rectangular parallelepiped metallic casing 111 as stated above, when the hoisting machine is operated at high frequency, a large amount of electric current flows through the regenerative braking resistor, resulting in a rise in temperature. The temperature rise causes the temperature of the inverter to rise as well. If the inverter temperature exceeds the above-described set temperature, the inverter is tripped. In a case where the load hoisting motor generates a large regenerative electric current, a plurality of resistors 110 need to be used. In such a case, it takes time and labor to wire and install the resistors 110.

As a countermeasure to be taken under circumstances where the motor generates a large amount of regenerative electric current during lowering of a load, there is a method wherein, as shown in FIG. 4(*a*), an increased number of resistance elements 112 are disposed in the metallic casing 111. With this method, however, the resistance elements 112 radiate heat toward each other and thus release a large amount of heat. On the other hand, the surface area of the metallic casing 111 cannot be increased sufficiently. Thus, the method is inferior in heat dissipation properties. To cope with this problem, there has been proposed a method wherein, as shown in FIG. 4(*b*), the resistor 110 is equipped with a heatsink 120 as a discrete member. This method suffers, however, from the problem that there is an increase in the dimensions of the resistor 110 including the heatsink 120, particularly the height dimension. In addition, if the condition of contact between the heatsink 120 and the resistor 110 is not satisfactory, the heat dissipation properties degrade. Further, the use of the heatsink 120 increases the number of component parts correspondingly and causes an increase in cost.

Patent Literature 1: Japanese Patent Application Publication No. Hei 8-91784

Patent Literature 2: Japanese Examined Utility Model Application Publication No. Hei 5-39603

Patent Literature 3: Japanese Patent Application Publication No. Hei 10-32101

DISCLOSURE OF INVENTION

Technical Problem

The present invention has been made in view of the above-described circumstances. Accordingly, an object of the present invention is to provide a hoisting machine capable of efficiently dissipating heat generated from an inverter and a regenerative braking resistor incorporated therein into the surrounding air with a simple structure and hence capable of performing high-frequency operation.

Solution to Problem

To solve the above-described problem, the present invention provides a hoisting machine having a load hoisting motor and a speed reduction mechanism and driving the load hoisting motor with an inverter incorporated in the hoisting machine main body. The hoisting machine is characterized by being provided with a heat dissipation means that dissipates heat generated from the inverter to a speed reduction mechanism casing that houses the speed reduction mechanism.

Thus, the hoisting machine is provided with a heat dissipation means that dissipates heat generated from the inverter to the speed reduction mechanism casing. Therefore, heat generated from the inverter can be efficiently dissipated to the surrounding air through the speed reduction mechanism casing having a large heat capacity. Further, because the interior of the speed reduction mechanism casing is an oil bath containing a lubricating oil, it is possible to expect cooling of the inverter by oil cooling. Accordingly, the inverter can be efficiently cooled, and the hoisting machine can be operated at high frequency.

In addition, the hoisting machine of the present invention is characterized in that the heat dissipation means is a means for attaching the inverter to the speed reduction mechanism casing in close contact therewith through surface contact at least a part of the inverter to dissipate heat generated from the inverter to the speed reduction mechanism casing.

Thus, the heat dissipation means is a means for attaching the inverter directly to the speed reduction mechanism casing in close contact therewith through surface contact at least a part of the inverter to dissipate heat generated from the inverter to the speed reduction mechanism casing. Therefore, heat generated from the inverter can be efficiently transferred and dissipated to the speed reduction mechanism casing with a simple structure. Further, because the inverter is attached directly to the speed reduction mechanism casing in close contact therewith, no space or member is interposed between the inverter and the speed reduction mechanism casing, and hence the hoisting machine can be constructed in a correspondingly compact form as a whole.

In addition, the hoisting machine of the present invention is characterized in that the speed reduction mechanism casing is made of an aluminum material.

Thus, the speed reduction mechanism casing is made of an aluminum material having a high thermal conductivity. Therefore, heat generated from the inverter can be dissipated speedily and even more efficiently.

In addition, the hoisting machine of the present invention is characterized in that the speed reduction mechanism casing is formed by aluminum the casting.

Thus, the speed reduction mechanism casing is formed by aluminum the casting. Because the aluminum die casting process enables the wall thickness of the speed reduction mechanism casing to be increased as compared to pressing, heat generated from the inverter can be efficiently transferred to the speed reduction mechanism casing.

In addition, the present invention provides a hoisting machine having a load hoisting motor, a speed reduction mechanism and a regenerative braking resistor and driving the load hoisting motor with an inverter incorporated in the hoisting machine main body and further passing an electric current generated by the load hoisting motor during lowering of a lifted load through the regenerative braking resistor to apply regenerative braking. The hoisting machine is characterized by being provided with a heat dissipation means that dissipates heat generated from the inverter to a speed reduction mechanism casing that houses the speed reduction mechanism.

Thus, the hoisting machine is provided with a heat dissipation means that dissipates heat generated from the inverter to the speed reduction mechanism casing. Therefore, heat generated from the inverter can be efficiently dissipated to the surrounding air through the speed reduction mechanism casing having a large heat capacity. Further, because the interior of the speed reduction mechanism casing is an oil bath containing a lubricating oil, it is possible to expect cooling of the inverter by oil cooling. Accordingly, the inverter can be efficiently cooled, and the inverter temperature can be maintained below a predetermined trip temperature. Thus, the hoisting machine can be operated at high frequency.

In addition, the hoisting machine of the present invention is characterized in that the heat dissipation means is a means for attaching the inverter to the speed reduction mechanism casing in close contact therewith through surface contact at least a part of the inverter to dissipate heat generated from the inverter to the speed reduction mechanism casing.

Thus, the heat dissipation means is a means for attaching the inverter to the speed reduction mechanism casing in close contact therewith through surface contact at least a part of the inverter to dissipate heat generated from the inverter to the speed reduction mechanism casing. Therefore, heat generated from the inverter can be efficiently transferred and dissipated to the speed reduction mechanism casing with a simple structure. Further, because the inverter is attached to the speed reduction mechanism casing in close contact therewith, no space or member is interposed between the inverter and the speed reduction mechanism casing, and hence the hoisting machine can be constructed in a correspondingly compact form as a whole.

In addition, the hoisting machine of the present invention is characterized in that the speed reduction mechanism casing is made of an aluminum material.

Thus, the speed reduction mechanism casing is made of an aluminum material having a high thermal conductivity. Therefore, heat generated from the inverter can be dissipated into the surrounding air even more efficiently, and the cooling effect is improved.

In addition, the hoisting machine of the present invention is characterized in that the regenerative braking resistor has a resistor casing comprising a corrugated metal plate and a flat metal plate that are superimposed over each other. The corrugated metal plate has an obverse surface with a concave-convex corrugated configuration and a reverse surface with a convex-concave corrugated configuration corresponding to the concave-convex corrugated configuration. Resistance elements are disposed in the concave spaces at the reverse side of the corrugated metal plate of the resistor casing, and an insulating material is filled in the space between the corrugated metal plate and the flat metal plate, including the concave spaces at the reverse side of the corrugated metal plate.

Thus, the regenerative braking resistor has resistance elements disposed in the concave spaces at the reverse side of the corrugated metal plate of the resistor casing and further has an insulating material filled in the space between the corrugated metal plate and the flat metal plate, including the concave spaces at the reverse side of the corrugated metal plate. Therefore, the obverse surface of the corrugated metal plate has a wide area, and this obverse surface with a wide area serves as a heat dissipation surface. Accordingly, heat from the resistance elements can be efficiently dissipated. Thus, heat from the regenerative braking resistor can be efficiently dissipated in addition to the advantage that heat from the inverter can be efficiently dissipated as stated above. Therefore, the hoisting machine can be operated at higher frequency than the above.

In addition, the hoisting machine of the present invention is characterized in that the corrugated metal plate and flat metal plate of the resistor casing are made of an aluminum material.

Thus, the corrugated metal plate and flat metal plate of the resistor casing of the regenerative braking resistor are made of an aluminum material. Because the aluminum material has a high thermal conductivity, it is possible to expect that heat generated from the resistance elements will be effectively dissipated.

In addition, the hoisting machine of the present invention is characterized in that the corrugated metal plate of the resistor casing is formed by aluminum die casting.

Thus, the corrugated metal plate of the resistor casing of the regenerative braking resistor is formed by aluminum die casting. Because the aluminum die casting process enables the wall thickness of the corrugated metal plate to be increased as compared to pressing, the corrugated metal plate also has the function of lowering the surface temperature of the resistor casing.

In addition, the hoisting machine of the present invention is characterized in that the regenerative braking resistor is attached to the casing of the hoisting machine with the flat metal plate of the resistor casing being in abutting contact with the outer surface of the casing of the hoisting machine.

Thus, the regenerative braking resistor is attached to the casing of the hoisting machine with the flat metal plate of the resistor casing being in abutting contact with the outer surface of the casing of the hoisting machine. Therefore, the surrounding air is in contact with the surface of the corrugated metal plate of the casing of the regenerative braking resistor. Thus, the heat dissipation action is further promoted. In addition, heat is dissipated from the flat metal plate of the regenerative braking resistor to the surface of the casing of the hoisting machine and dissipated into the surrounding air from the surface of the hoisting machine casing. Therefore, heat dissipation is further promoted. In addition, the casing and the speed reduction mechanism casing are divided from each other by a gasket having a low thermal conductivity. Thus, heat generated from the inverter is dissipated through the speed reduction mechanism casing, while heat generated from the regenerative braking resistor is dissipated directly into the surrounding air and through the surface of the hoisting machine casing. Accordingly, it is possible to control the amount of heat dissipated through each part of the hoisting machine casing surface and hence possible to enhance the overall heat dissipation effect.

In addition, the hoisting machine of the present invention is characterized in that the regenerative braking resistor is disposed such that the longitudinal direction of concave grooves constituting the concave-convex corrugated configuration of the corrugated metal plate of the resistor casing is the vertical direction.

Thus, the regenerative braking resistor is disposed such that the longitudinal direction of concave grooves constituting the concave-convex corrugated configuration of the corrugated metal plate of the resistor casing is the vertical direction. Consequently, the air heated by the surface of the corrugated metal plate ascends through the concave grooves of the concave-convex corrugated configuration in the form of an ascending current and is released from the upper ends of the concave grooves, and at the same time, the surrounding air flows into the concave grooves from the lower ends thereof, thereby further promoting the heat dissipation action.

BEST MODE FOR CARRYING OUT THE INVENTION

An embodiment of the present invention will be explained below with reference to the accompanying drawings. FIG. 5 is a sectional plan view showing an example of the internal structure of a control box of an electric chain block according to the present invention. As illustrated in the figure, an inverter 12 is attached directly to a speed reduction mechanism casing 15. In this regard, the inverter 12 and the speed reduction mechanism casing 15 have respective contact surfaces that are flat relative to each other so as to be attached in close contact (surface contact) with each other. The speed reduction mechanism casing 15 is formed by aluminum die casting and contains a lubricating oil (not shown) for lubricating gears and so forth (not shown) constituting a speed reduction mechanism.

In a control box 10 are disposed an electromagnetic switch 13 and a transformer 14 that are mounted on a steel panel 11. When the electric chain block is operated at high frequency, a large amount of heat is generated from the inverter 12 as stated above. The heat is transferred from the inverter 12 to the speed reduction mechanism casing 15 and dissipated into the surrounding air from the speed reduction mechanism casing 15. The speed reduction mechanism casing 15 is made of an aluminum material having a high thermal conductivity and formed with an increased wall thickness by die casting, as stated above. Therefore, heat generated from the inverter 12 is efficiently transferred to the speed reduction mechanism casing 15 and dissipated into the surrounding air. In addition, the speed reduction mechanism casing 15 contains a lubricating oil and thus forms an oil bath. Therefore, cooling of the inverter by oil cooling can also be expected. Further, because the inverter 12 is attached directly to the speed reduction mechanism casing 15, the control box 10 can be reduced in size from the size shown by the dotted lines to the size shown by the solid lines (i.e. the overall length of the electric chain block is reduced).

Further, the inverter 12 can be efficiently cooled with a very simple structure that the inverter 12 and the speed reduction mechanism casing 15 have respective contact surfaces that are flat relative to each other so as to be attached in close contact with each other. Particularly, the speed reduction mechanism casing 15 does not contain components that generate heat, such as an inverter 12, a load hoisting motor 41 and a mechanical brake 51 for preventing a fall of a lifted load. In this regard also, effective cooling of the inverter 12 can be expected.

FIG. 6 is a sectional plan view showing an example of the overall structure of the electric chain block having the control box 10 arranged as stated above. The electric chain block 20 has a main body casing 21. The control box 10 is connected to one end of the main body casing 21, and the inverter 12 in the control box 10 is attached directly to the speed reduction mechanism casing 15. One end of a motor casing 40 is connected to the other end of the main body casing 21. A fan cover 50 is connected to the other end of the motor casing 40. The main body casing 21 houses a chain block main body 22. The motor casing 40 houses a load hoisting motor 41. The fan cover 50 covers a fan blade 54 and a lifted-load fall preventing mechanical brake 51.

The chain block main body 22 has a hollow driven shaft 26 and a driving shaft 25 extending through the hollow driven shaft 26. The hollow driven shaft 26 is rotatably supported through bearings 23 and 24. The driving shaft 25 is rotatably supported through bearings 34 and 35. One end of the driving shaft 25 is connected to a rotating shaft 46 of the load hoisting motor 41. The other end of the driving shaft 25 extends through the hollow driven shaft 26 and has gear teeth formed on the outer periphery of a portion thereof projecting from the hollow driven shaft 26. The gear teeth are in mesh with a large-diameter intermediate driven gear 27. The large-diameter intermediate driven gear 27 is fixed to a rotating shaft 28. The rotating shaft 28 is rotatably supported by the speed reduction mechanism casing 15 through bearings 29 and 30. The rotating shaft 28 has a small-diameter intermediate driven gear 31 fixed thereto. The small-diameter intermediate driven gear 31 is in mesh with a large-diameter driven gear 32 fixed to the hollow driven shaft 26. Further, the hollow driven shaft 26 has a load sheave 33 connected thereto.

The load hoisting motor 41 has a stator 42 and a rotor 43. The stator 42 is fitted and fixed in the motor casing 40. The rotor 43 is fixed to the rotating shaft 46 rotatably supported through bearings 44 and 45. The rotor 43 extends through the center of the stator 42. The lifted-load fall preventing mechanical brake 51 has a brake plate 52 fixed to the motor casing 40 and a brake plate 53 fixed to the rotating shaft 46. When the power supply to the load hoisting motor 41 is cut off, the mechanical brake 51 automatically presses the brake plate 52 against the brake plate 53 with a spring to lock the rotating shaft 46, thereby preventing a fall of a lifted load. When the power supply is connected to the load hoisting motor 41, the mechanical brake 51 separates the brake plate 52 from the brake plate 53 against the spring force by the magnetic force of an electromagnet, thereby unlocking the rotating shaft 46. It should be noted that a fan blade 54 is attached to the end of the rotating shaft 46.

In the electric chain block arranged as stated above, the rotational force of the rotating shaft 46 of the load hoisting motor 41 is transmitted to the driving shaft 25 of the chain block main body 22 and further transmitted to the hollow driven shaft 26 through the large-diameter intermediate driven gear 27 meshed with the gear teeth formed on the driving shaft 25 and further through the small-diameter intermediate driven gear 31 and the large-diameter driven gear 32. The rotational force transmitted to the hollow driven shaft 26 is transmitted to the load sheave 33 connected to the hollow driven shaft 26 to lift and lower a chain (not shown). That is, the rotational force of the load hoisting motor 41 is transmitted to the hollow driven shaft 26 through a speed reduction mechanism comprising the large-diameter intermediate driven gear 27, the small-diameter intermediate driven gear 31 and the large-diameter driven gear 32 to rotate the load sheave 33. It should be noted that the speed reduction mechanism casing 15 contains a lubricating oil (not shown) for lubricating the gear teeth formed on the driving shaft 25, the large-diameter intermediate driven gear 27, the small-diameter intermediate driven gear 31 and the large-diameter driven gear 32, which constitute the above-described speed reduction mechanism.

FIG. 7 is a diagram schematically showing the arrangement of a driving circuit for the electric chain block. An electromagnetic switch 60 is closed to turn on the power supply to the inverter 12, and control signals such as forward rotation, reverse rotation and speed signals are applied to the inverter 12 from a control circuit 61. Consequently, the load hoisting motor 41 rotates forward (in the direction for lifting a lifted load) or reverse (in the direction for lowering the lifted load) at a specified speed. When the electric chain block is operated at high frequency, i.e. when the operating time of the hoisting machine accounts for 60% or more of the sum total (100%) of the operating time and down time, a large amount of heat is generated from the inverter 12. In this regard, the inverter 12 is attached directly to the speed reduction mechanism casing 15 as stated above. Accordingly, the heat from the inverter 12 is efficiently dissipated into the surrounding air through the speed reduction mechanism casing 15, and hence the inverter 12 is effectively cooled. In addition, the speed reduction mechanism casing 15 contains a lubricating oil and thus forms an oil bath, as stated above. Therefore, the inverter 12 is also oil-cooled. Thus, even if the hoisting machine is operated at high frequency, the inverter 12 will not heat up to a predetermined trip temperature (e.g. 100° C.) or more and thus can avoid being tripped.

In addition, as shown in FIG. 6, a regenerative braking resistor 70 is attached to a side of the control box 10. When the load hoisting motor 41 lowers the lifted load, it functions as a generator, and a regenerative electric current generated in this way is passed through the regenerative braking resistor 70 and thus consumed, thereby regeneratively braking the load hoisting motor 41. In addition, during the operation of the load hoisting motor 41, the fan blade 54 rotates to send air to the lifted-load fall preventing mechanical brake 51 and the load hoisting motor 41 to cool them.

FIG. 8 is a diagram showing an example of the structure of the regenerative braking resistor 70. FIG. 8(*a*) is a plan view. FIG. 8(*b*) is a front view. FIG. 8(*c*) is an A-A sectional view. As illustrated in these figures, the regenerative braking resistor 70 has a casing 71 comprising a corrugated metal plate 72 and a flat metal plate 73. The corrugated metal plate 72 is formed by die casting of an aluminum material to have an obverse surface with a concave-convex corrugated configuration and a reverse surface with a convex-concave corrugated configuration corresponding to the concave-convex corrugated configuration. The height H1 of two opposite sides of the corrugated metal plate 72 is greater than the height H2 of the concave-convex corrugated portion thereof (H1>H2). The flat metal plate 73 is formed from a flat aluminum material. The corrugated metal plate 72 and the flat metal plate 73 are superimposed over each other to constitute the casing 71.

Resistance elements 74 are disposed in the concave spaces 75 at the reverse side of the corrugated metal plate 72 of the casing 71, and an insulating filler 76 is filled in the space between the corrugated metal plate 72 and the flat metal plate 73, including the concave spaces 75. As the insulating filler 76, a heat-resisting cement, e.g. heat-resisting silicone cement, is used. Regarding joining of the corrugated metal plate 72 and the flat metal plate 73, the flat metal plate 73 is secured to the corrugated metal plate 72 by threading screws 77 into the corrugated metal plate 72 through the flat metal plate 73. A plurality of resistance elements 74 are electrically connected in series, and lead terminals 80 for supplying an electric current to the resistance elements 74 are led out from one side of the casing 71.

The resistance elements 74 may be any type of resistance element that can efficiently convert an electric current passed therethrough into heat. An example of usable resistance elements comprises, as shown in FIG. 9, a columnar member (or cylindrical member) 78 made of a heat-resisting insulating material, e.g. a ceramic material, and a resistance wire 79, e.g. a nichrome wire, wound around the columnar member 78.

With the above-described structure of the regenerative braking resistor 70, when an electric current is passed through the resistance elements 74, heat generated therefrom is transferred to the corrugated metal plate 72 made of an aluminum material of good thermal conductivity through the insulating filler 76. The corrugated metal plate 72 has its obverse surface formed into a concave-convex corrugated configuration to have a wide surface area and hence efficiently dissipates the transferred heat into the surrounding air. Further, because the corrugated metal plate 72 is formed by aluminum die casting, the wall thickness thereof can be increased as compared to pressing. Accordingly, the corrugated metal plate 72 has the advantageous effect of lowering the surface temperature.

As shown in FIG. 10, the regenerative braking resistor 70 is attached to the outer side surface of the control box 10. An electric current generated by the load hoisting motor 41 during lowering of a lifted load is passed through the resistance elements 74 of the regenerative braking resistor 70, and heat generated from the resistance elements 74 at this time is transferred to the corrugated metal plate 72 of an aluminum material through the insulating filler 76. The corrugated metal-plate 72 of the regenerative braking resistor 70 is formed by aluminum die casting to have an obverse surface with a concave-convex corrugated configuration as stated above. Therefore, the corrugated metal plate 72 has a wide surface area and is therefore capable of efficiently dissipating the heat from the resistance elements 74. Because the corrugated metal plate 72 is formed by aluminum die casting, in particular, the wall thickness of the corrugated metal plate 72 can be increased as compared to pressing. Thus, the corrugated metal plate 72 also has the advantageous effect of lowering the surface temperature.

The control box 10 and the speed reduction mechanism casing 15 are divided from each other by a gasket 16 of low thermal conductivity. The installation position of the gasket 16 of low thermal conductivity is properly changed according to the amount of heat generated from the inverter 12 attached to the speed reduction mechanism casing 15, the high-temperature performance of the inverter 12, the amount of heat generated from the regenerative braking resistor 70 attached to the control box 10, and so forth, thereby controlling the amount of heat dissipated from each part of the electric chain block casing surface and the range of conduction of heat. Among the components, the regenerative braking resistor 70 generates heat most. Therefore, an effective practice is to increase the surface area of the electric chain block casing for dissipating the heat generated from the regenerative braking resistor 70. It is, however, not preferable from the viewpoint of the heat resistance of the inverter 12 that the heat of the regenerative braking resistor 70 influence the inverter 12 attached to the speed reduction mechanism casing 15. It is also necessary to dissipate the heat generated from the inverter 12 from the surface of the electric chain block casing. Therefore, in a case where the inverter 12 has high heat resistance and generates a relatively small amount of heat, the gasket 16 is installed at a position at which the surface area of the control box 10 is widened. In a case where the inverter 12 has low heat resistance or generates a relatively large amount of heat, the gasket 16 is installed at a position at which the surface area of the control box 10 is narrowed and the surface area of the speed reduction mechanism casing is correspondingly widened. By so doing, the overall heat dissipation performance of the hoisting machine can be effectively improved. It should be noted that FIG. 10 is an enlarged view of a part of FIG. 6 that shows the control box 10.

FIG. 11 is an enlarged view of a part of the electric chain block according to the present invention, showing another example of the internal structure of the control box 10. As illustrated in the figure, a recess 81 is formed on a side of the control box 10, and a regenerative braking resistor 70 serving as a braking resistance is disposed in the recess 81. The opening of the recess 81 is covered with a plate member 82 having a plurality of slits 82*a* as shown in FIG. 12. With the arrangement in which the regenerative braking resistor 70 is disposed in the recess 81 formed on the side of the control box 10, the regenerative braking resistor 70 does not project from the side of the control box 10 unlike the arrangement shown in FIG. 10. Accordingly, the external appearance is improved.

Here, as shown in FIG. 13, the regenerative braking resistor 70 is disposed such that the concave grooves 72*a* of the corrugated metal plate 72 extend in the vertical direction, and vertical grooves 10*a* are formed on the upper and lower edges of the recess 81 of the control box 10. Thus, air A flowing in through the grooves 10*a* formed on the lower edge of the recess 81 enters the space between the plate member 82 and the corrugated metal plate 72 (see FIG. 11) where the air A is heated by heat radiated from the surface of the corrugated metal plate 72. The heated air A ascends through the concave grooves 72*a* in the form of an ascending current and flows out through the grooves 10*a* formed on the upper edge of the recess 81. At the same time, cold fresh air flows in from the lower side. Thus, the cooling effect is further promoted. It should be noted that FIG. 13 is a diagram showing a side surface of the control box 10 with the plate member 82 removed therefrom.

The resistance elements 74 of the regenerative braking resistor 70 are disposed in the concave spaces 75 at the reverse side of the corrugated metal plate 72 of the casing 21, as stated above. Regarding the installation position thereof, the resistance elements 74 may be positioned in the respective openings of the concave spaces 75 as shown in FIG. 14(*a*), or in the respective upper portions of the concave spaces 75 as shown in FIG. 14(*b*), or directly below the respective concave spaces 75 as shown in FIG. 14(*c*). Among these positions, the best heat dissipation effect was obtained when the resistance elements 74 were positioned in the respective openings of the concave spaces 75 as shown in FIG. 14(*a*).

With the electric chain block, the control box 10 was arranged as shown in FIG. 11, and the regenerative braking resistor 70 was formed by using a resistor having resistance elements 74 disposed at the respective positions shown in FIG. 14(*a*). The electric chain block was operated at high frequency to measure the following various temperatures when the saturation temperatures were reached: the surface temperature A of the speed reduction mechanism casing 15; the outer wall surface temperature B of the control box 10; the surface temperature C of the corrugated metal plate 72 of the regenerative braking resistor 70; the temperature D at the bottom of the concave grooves 72*a*; and the surface temperature E of the speed-reduction mechanism casing 15 at a part thereof where the inverter 12 is attached. The measurement results were all satisfactory. Thus, the electric chain block was proved to be capable of performing high-frequency operation.

Although an embodiment of the present invention has been described above, the present invention is not limited to the foregoing embodiment but can be modified in a variety of ways without departing from the scope of the claims and the technical idea indicated in the specification and the drawings. For example, although in the foregoing embodiment an electric chain block has been described as a hoisting machine, by way of example, the hoisting machine according to the present invention may be an electric hoist that winds up and unwinds a wire rope on and from a drum.

Further, in the foregoing embodiment, the heat dissipation means that dissipates heat generated from the inverter 12 to the speed reduction mechanism casing 15 is a means for attaching the inverter 12 directly to the speed reduction mechanism casing 15 in close contact therewith to dissipate heat generated from the inverter 12 to the speed reduction mechanism casing 15. The heat dissipation means is not limited thereto. For example, a heat transfer means, e.g. a heat pipe, may be used to transfer heat generated from the inverter 12 to the speed reduction mechanism casing 15. The use of another heat transfer means or a combination of the heat dissipation means and another heat transfer means is effective particularly when the inverter cannot be attached directly to the speed reduction mechanism casing, or when a wide part of the side wall of the inverter cannot be attached directly to the speed reduction mechanism casing.

INDUSTRIAL APPLICABILITY

The hoisting machine according to the present invention dissipates heat generated from the inverter to the speed reduction mechanism casing. Therefore, it is possible to effectively dissipate heat generated from the inverter into the surrounding air through the speed reduction mechanism casing having a large heat capacity. Further, because the speed reduction mechanism casing contains a lubricating oil and hence forms an oil bath, it is also possible to expect cooling of the inverter by oil cooling. Accordingly, the invention of this application can provide an inverter-incorporating hoisting machine capable of performing high-frequency operation.

The hoisting machine according to the present invention uses, as a regenerative braking resistor, a resistor in which resistance elements are disposed in concave spaces at the reverse side of a corrugated metal plate constituting a resistor casing and an insulating material is filled in the space between the corrugated metal plate and the associated flat metal plate, including the concave spaces at the reverse side of the corrugated metal plate. Thus, the corrugated metal plate provides a wide surface area, and the corrugated metal plate surface having a wide area serves as a heat dissipation surface. Therefore, heat from the resistance elements can be dissipated effectively. Accordingly, heat from the regenerative braking resistor can be efficiently dissipated in addition to the advantage that heat from the inverter can be efficiently dissipated as stated above. Thus, the invention of this application can provide an inverter-incorporating hoisting machine capable of performing high-frequency operation.

BRIEF DESCRIPTION OF THE DRAWINGS

FIG. 3 is a diagram showing a structural example of a regenerative braking resistor of a conventional hoisting machine, of which: FIG. 3(*a*) is a plan view; FIG. 3(*b*) is a front view; and FIG. 3(*c*) is a right-hand side view.

FIG. 4 is a diagram showing a structural example of a regenerative braking resistor of a conventional hoisting machine, of which: FIG. 4(*a*) is a plan view; and FIG. 4(*b*) is a front view.

FIG. 8 is a diagram showing a structural example of a regenerative braking resistor of the electric chain block according to the present invention, of which: FIG. 8(*a*) is a plan view; FIG. 8(*b*) is a front view; and FIG. 8(*c*) is an A-A sectional view.

LIST OF REFERENCE SIGNS

Figure 1:
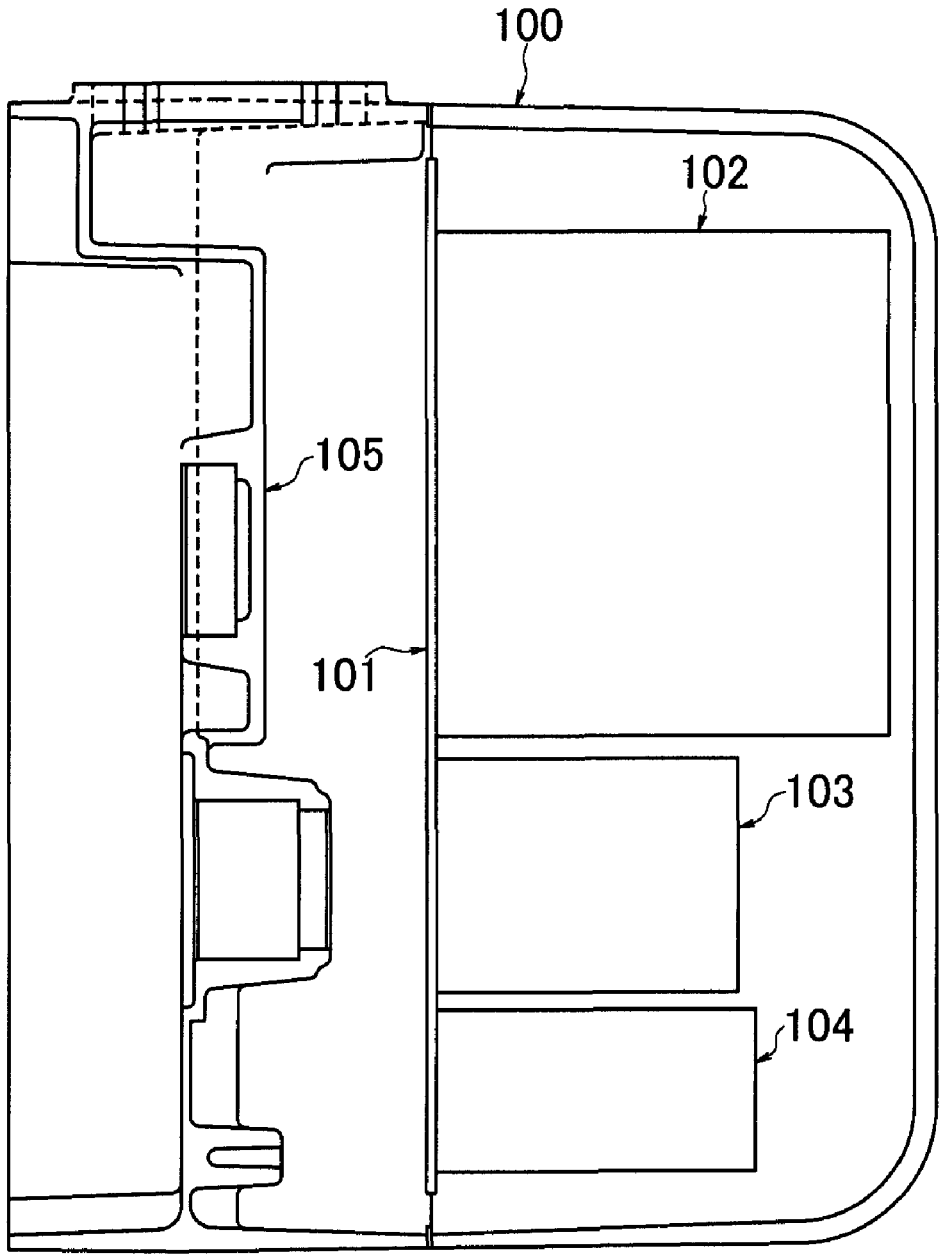
FIG. 1 is a sectional plan view showing the internal structure of a control box of a conventional electric chain block.
Figure 2:
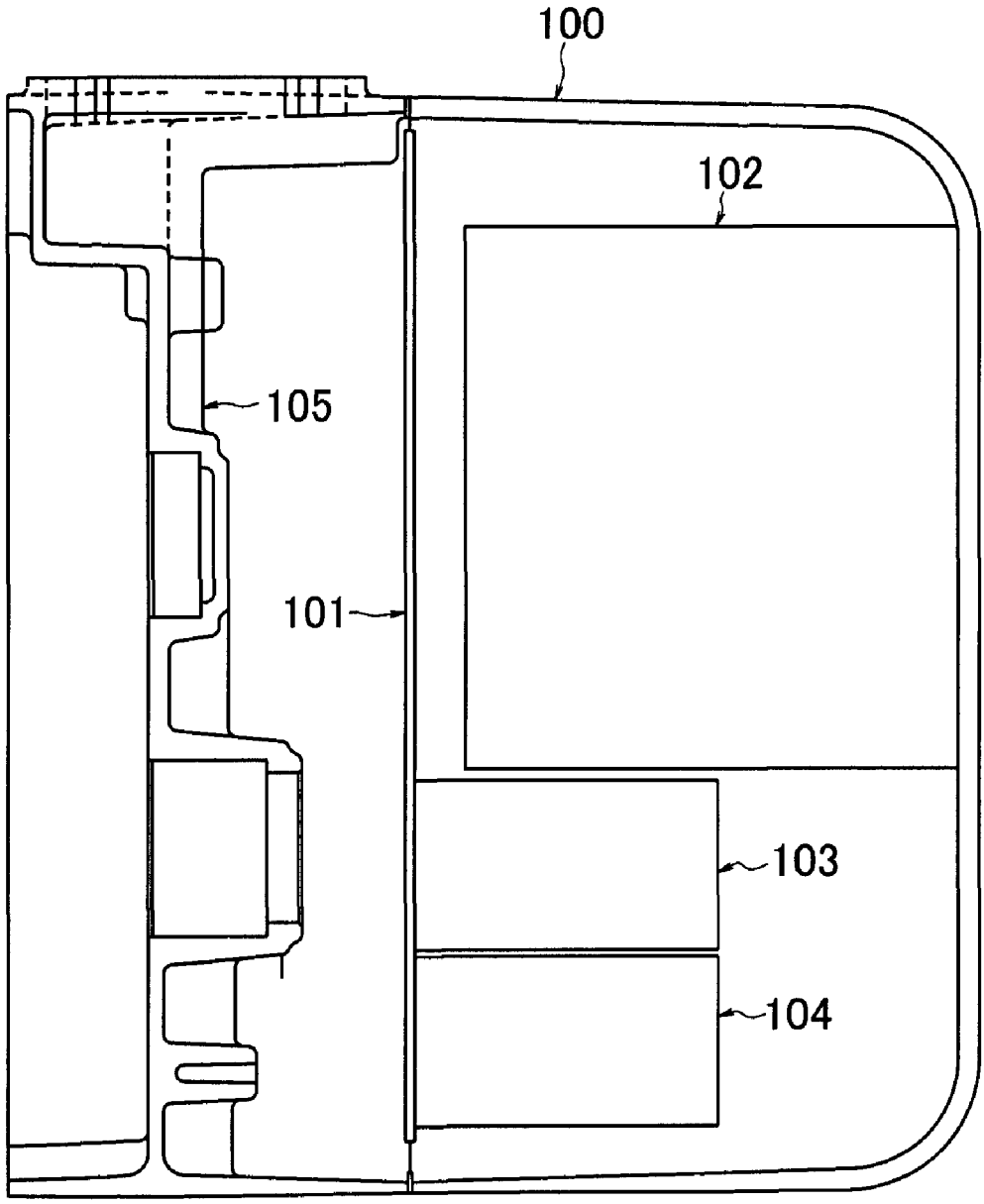
FIG. 2 is a sectional plan view showing the internal structure of a control box of a conventional electric chain block.
Figure 3:
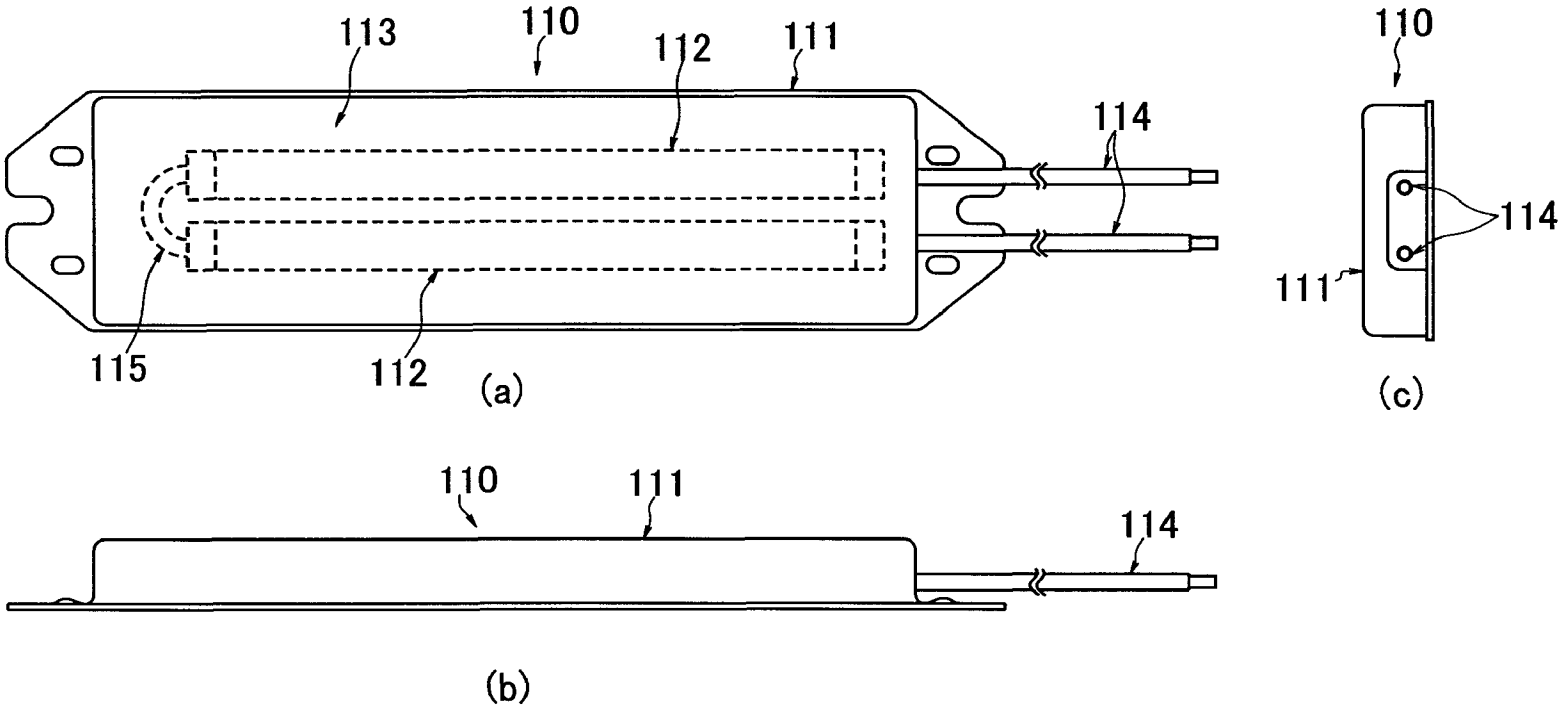
Figure 4:
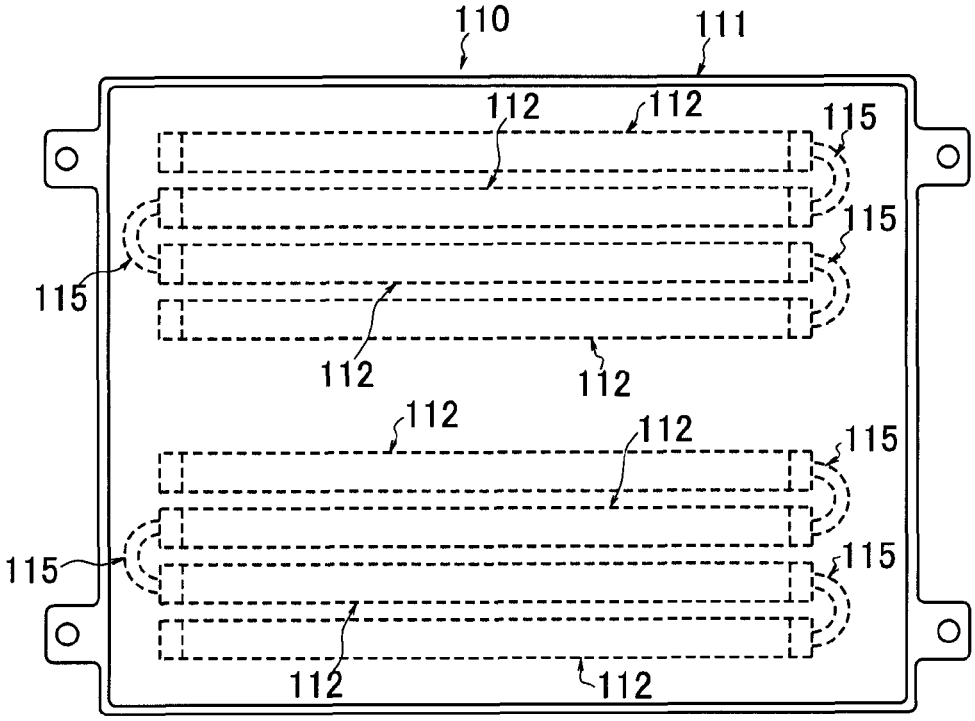
Figure 4:
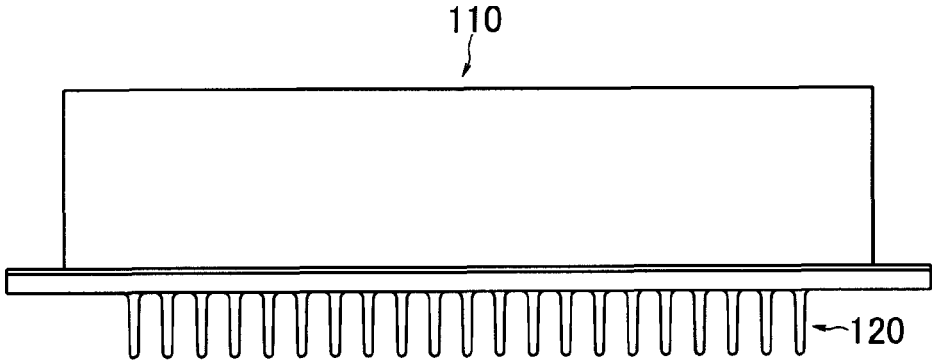
Figure 5:
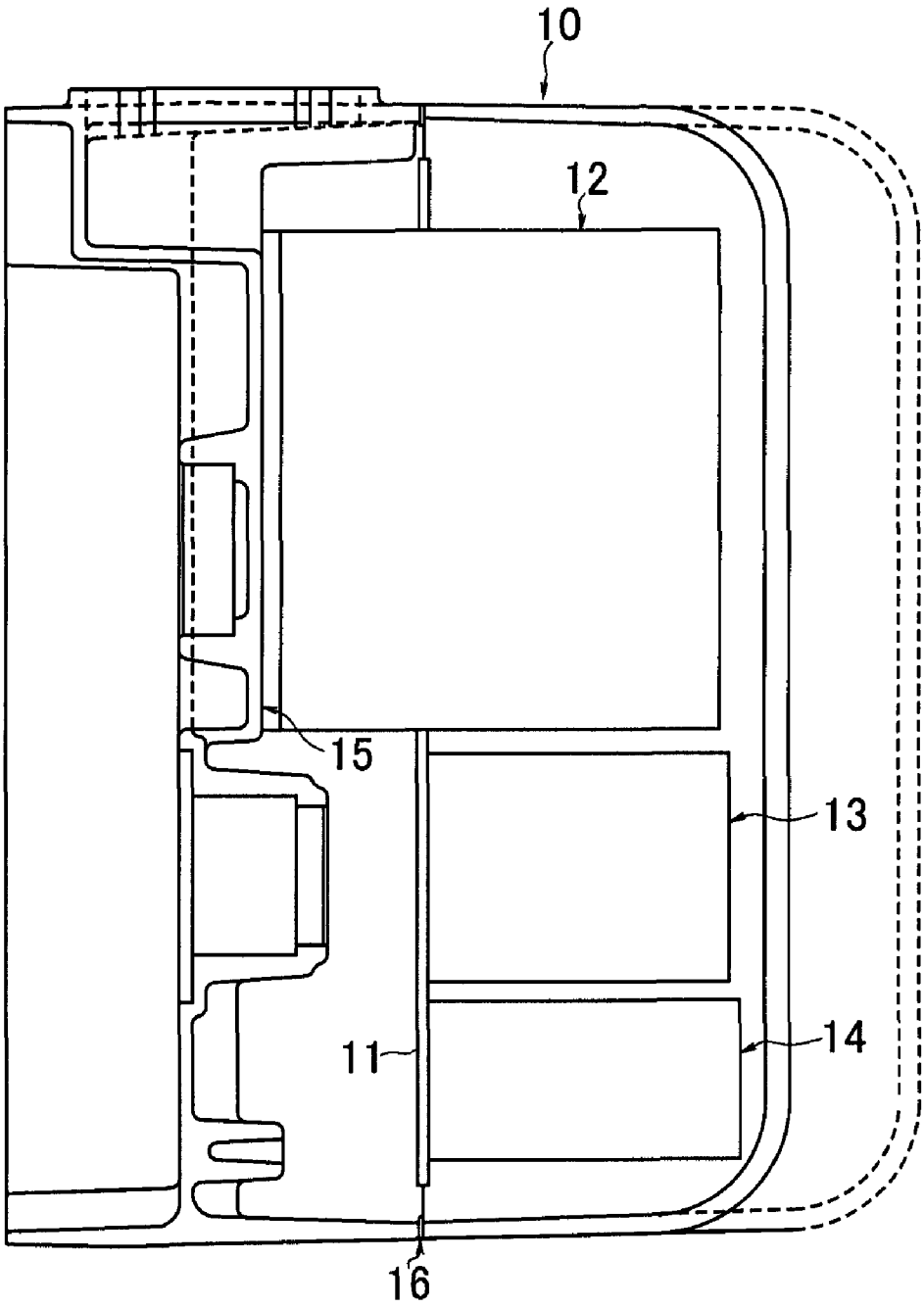
FIG. 5 is a sectional plan view showing an example of the internal structure of a control box of an electric chain block according to the present invention.
Figure 6:
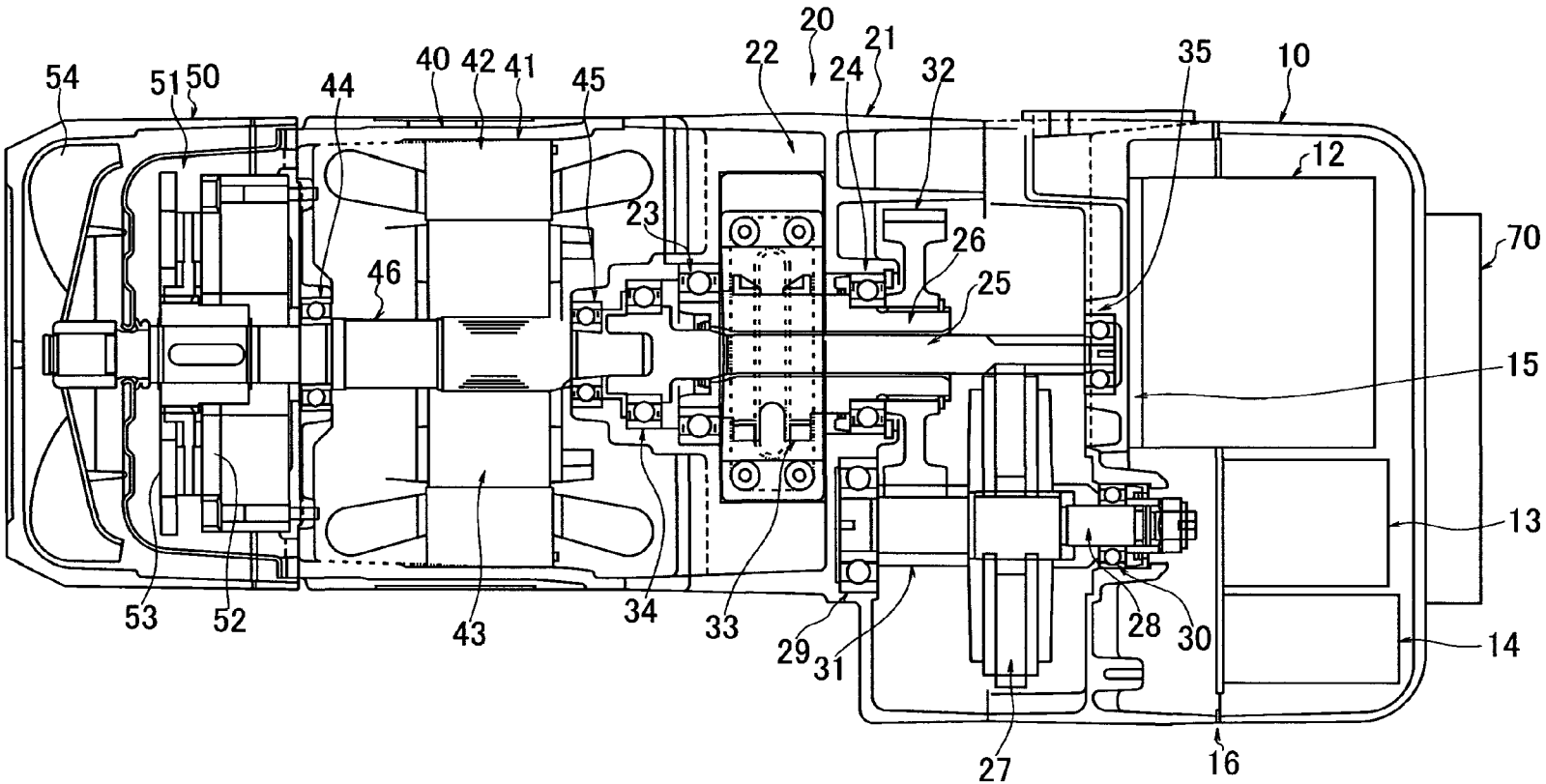
FIG. 6 is a sectional plan view showing an example of the overall structure of the electric chain block according to the present invention.
Figure 7:
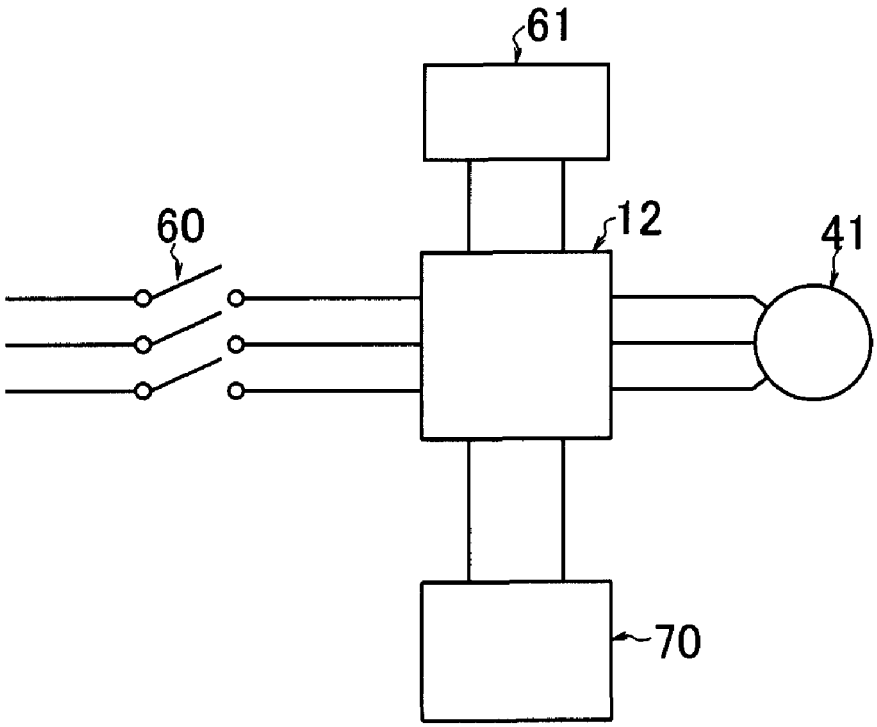
FIG. 7 is a diagram schematically showing the configuration of a driving circuit for the electric chain block.
Figure 8:
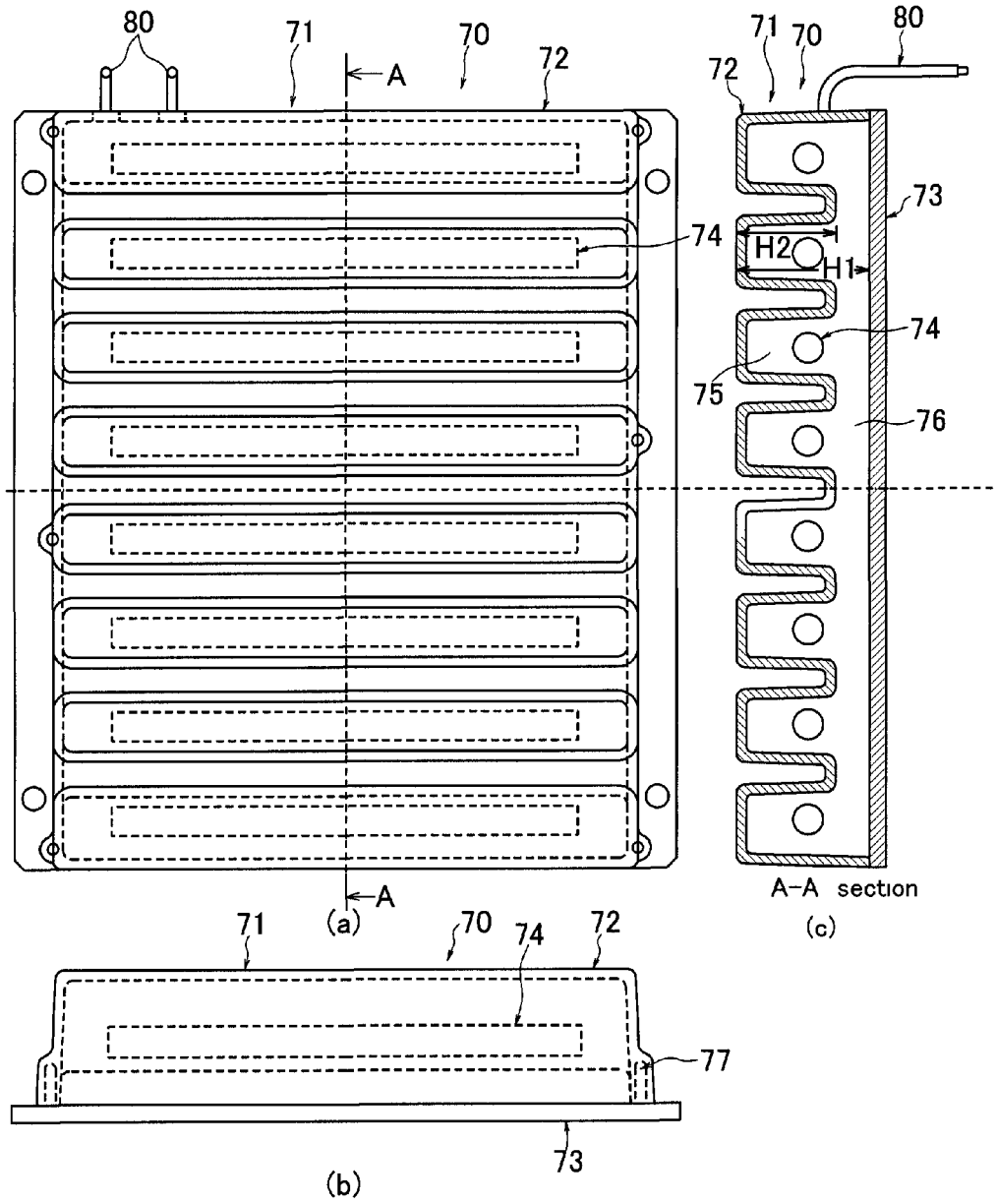
Figure 9:
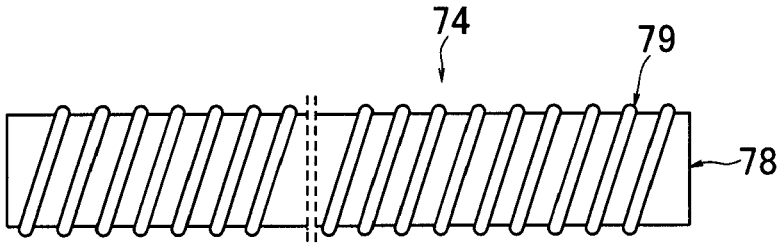
FIG. 9 is a diagram showing a structural example of a resistance element.
Figure 10:
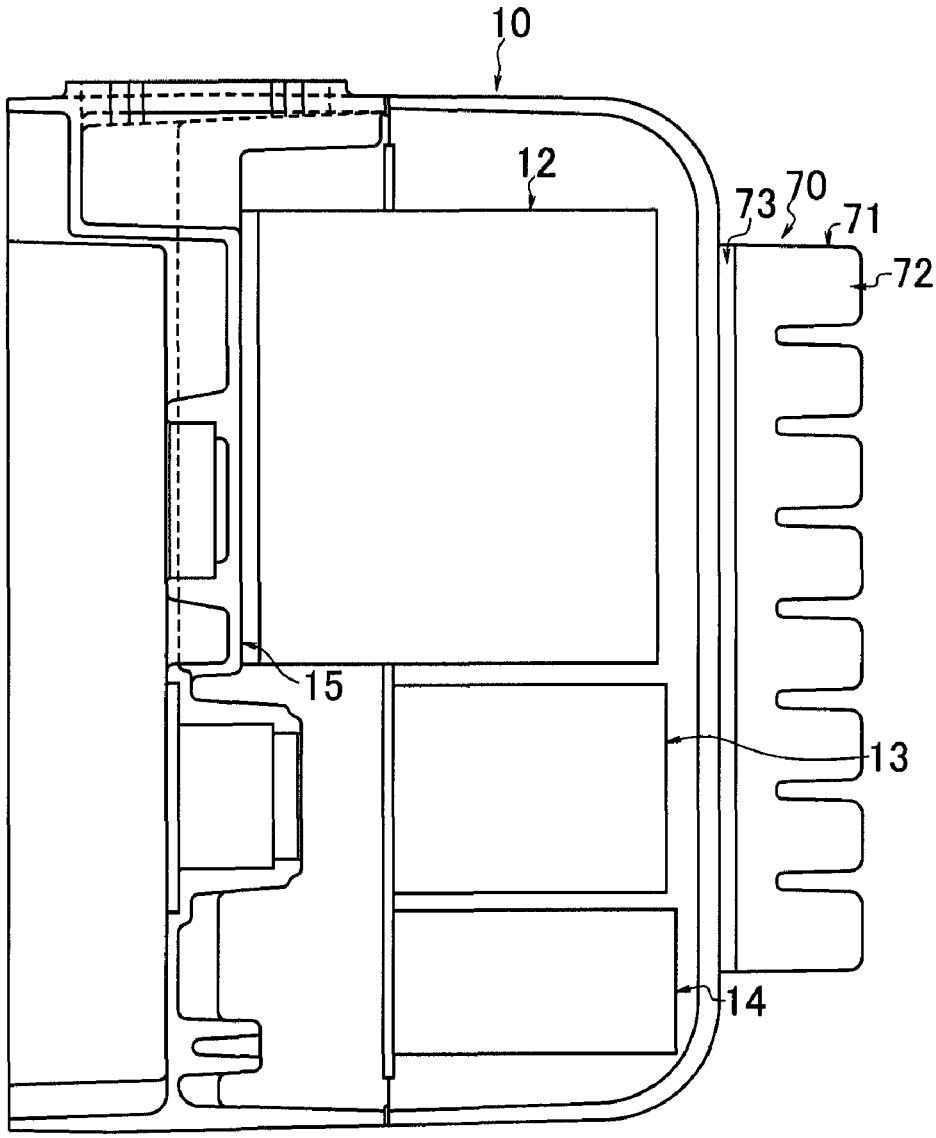
FIG. 10 is a sectional plan view showing another example of the internal structure of the control box of the electric chain block according to the present invention.
Figure 11:
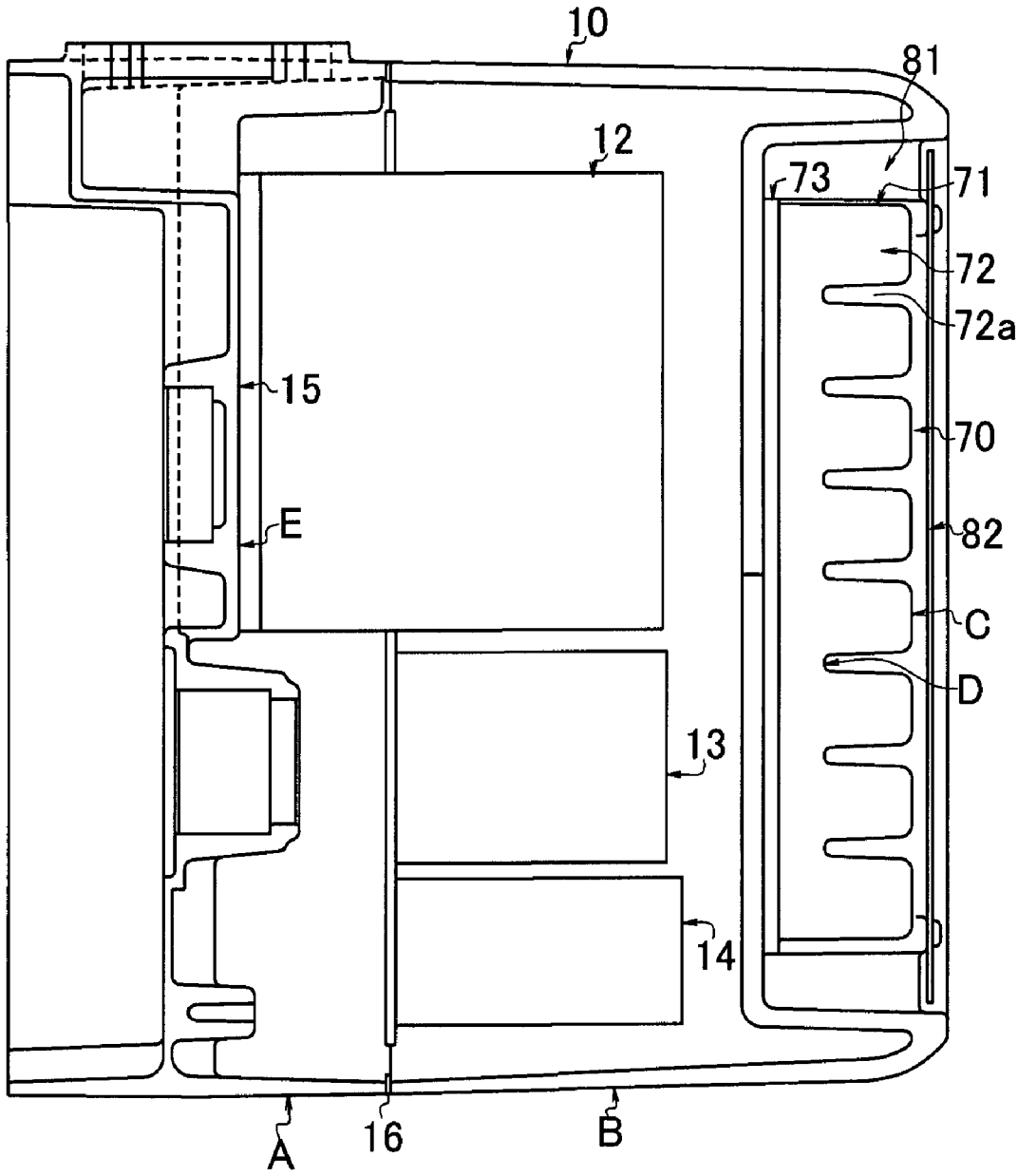
FIG. 11 is a sectional plan view showing still another example of the internal structure of the control box of the electric chain block according to the present invention.
Figure 12:
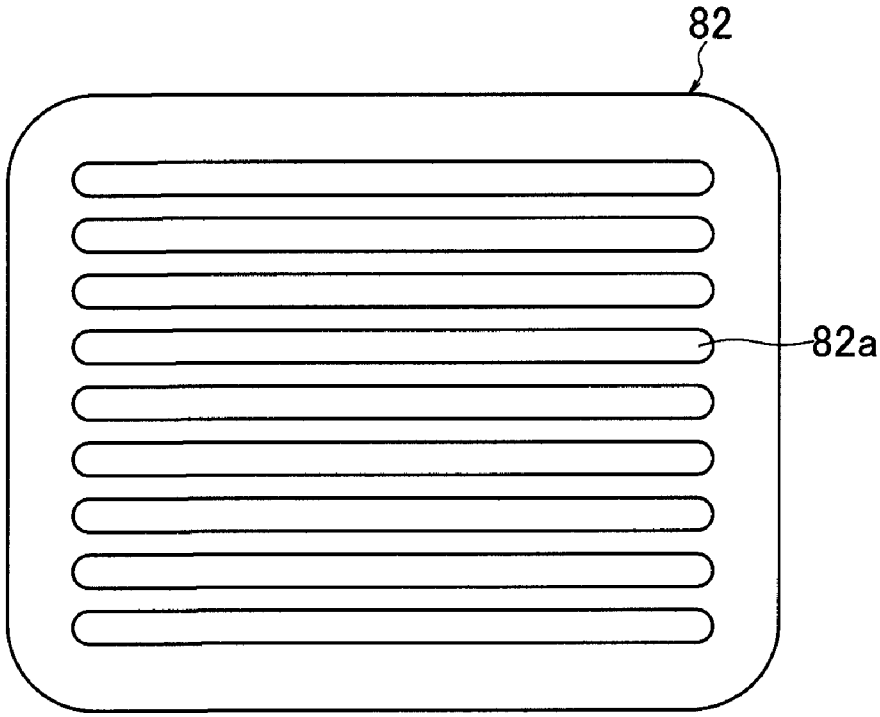
FIG. 12 is a diagram showing the external shape of a cover for the regenerative braking resistor of the electric chain block according to the present invention.
Figure 13:
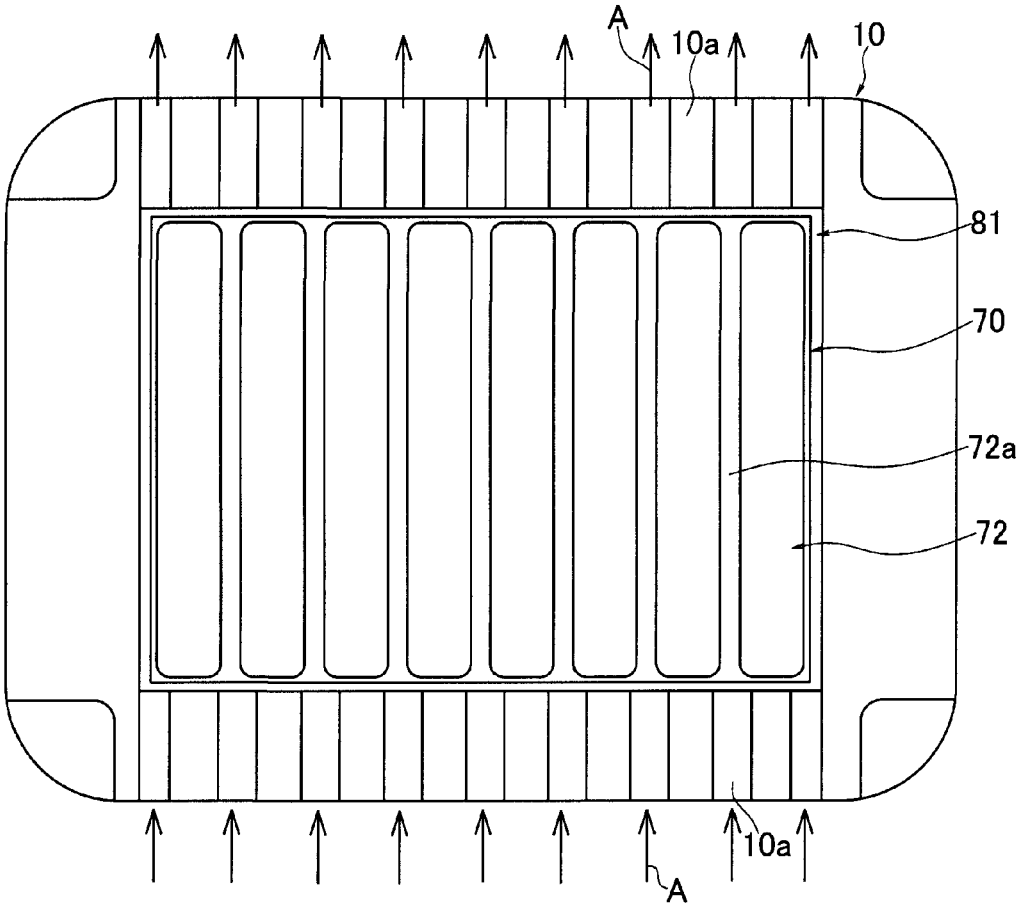
FIG. 13 is a diagram showing the position where the regenerative braking resistor is installed in the control box of the electric chain block according to the present invention.
Figure 14:
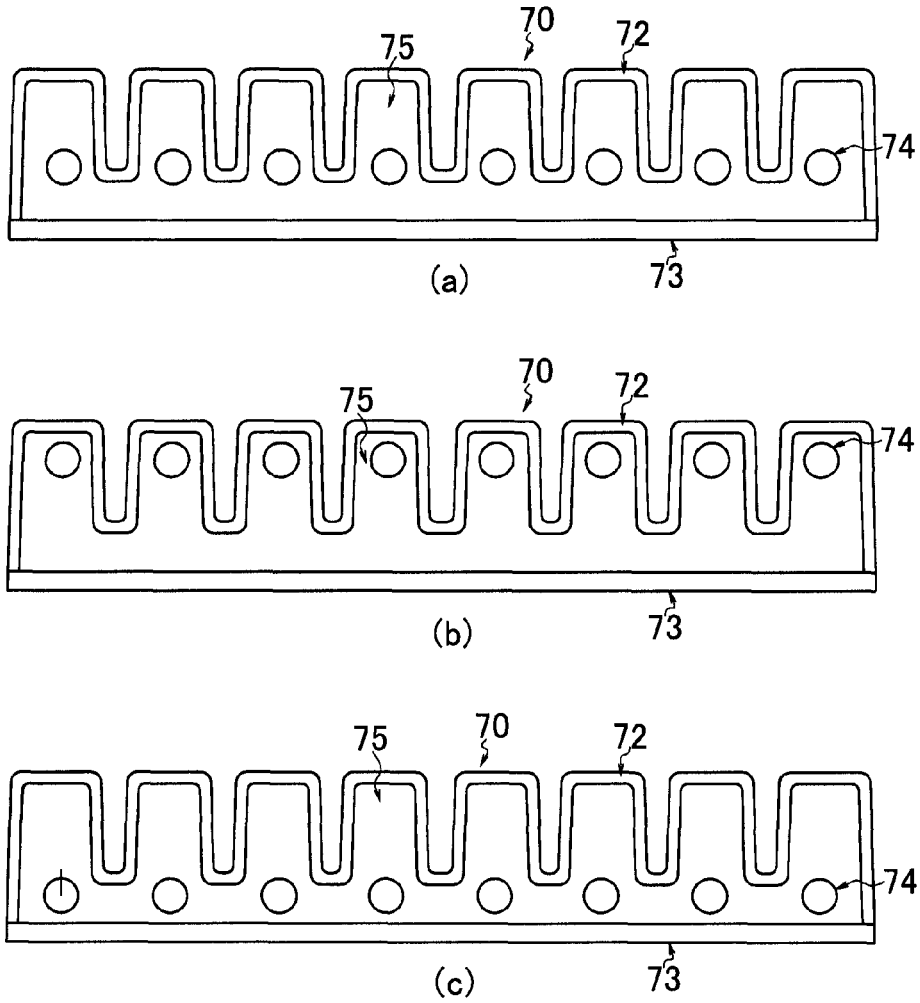
FIG. 14 is a diagram showing the installation position of resistance elements in a resistor casing of the regenerative braking resistor of the electric chain block according to the present invention.

10: control box
11: panel
12: inverter
13: electromagnetic switch
14: transformer
15: speed reduction mechanism casing
16: gasket
20: electric chain block
21: main body casing
22: chain block main body
23: bearing
24: bearing
25: driving shaft
26: hollow driven shaft
27: large-diameter intermediate driven gear
28: rotating shaft
29: bearing
30: bearing
31: small-diameter intermediate driven gear
32: large-diameter driven gear
33: load sheave
34: bearing
35: bearing
40: motor casing
41: load hoisting motor
42: stator
43: rotor
44: bearing
45: bearing
46: rotating shaft
50: fan cover
51: lifted-load fall preventing mechanical brake
52: brake plate
53: brake plate
54: fan blade
60: electromagnetic switch
61: control circuit
70: regenerative braking resistor
72: corrugated metal plate
73: flat metal plate
74: resistance element
75: concave space
76: insulating filler

77: screw
78: columnar member (or cylindrical member)
79: resistance wire
80: lead terminal
81: recess
82: plate member

The invention claimed is:

1. A hoisting machine having a load hoisting motor, a speed reduction mechanism and a regenerative braking resistor and driving said load hoisting motor with an inverter incorporated in a hoisting machine main body and further passing an electric current generated by said load hoisting motor during lowering of a lifted load through said regenerative braking resistor to apply regenerative braking, which is characterized by comprising:

a heat dissipation means that dissipates heat generated from said inverter to a speed reduction mechanism casing that houses said speed reduction mechanism;

said regenerative braking resistor having a resistor casing comprising a corrugated metal plate and a flat metal plate that are superimposed over each other, said corrugated metal plate having an obverse surface with a concave-convex corrugated configuration and a reverse surface with a convex-concave corrugated configuration corresponding to said concave-convex corrugated configuration;

wherein resistance elements are disposed in concave spaces at a reverse side of the corrugated metal plate of said resistor casing, and an insulating material is filled in a space between said corrugated metal plate and said flat metal plate, including the concave spaces at the reverse side of said corrugated metal plate.

2. The hoisting machine of claim 1, wherein the corrugated metal plate and flat metal plate of said resistor casing are made of an aluminum material.

3. The hoisting machine of claim 2, wherein the corrugated metal plate of said resistor casing is formed by aluminum die casting.

4. The hoisting machine of claim 1, wherein said regenerative braking resistor is attached to a casing of said hoisting machine with the flat metal plate of said resistor casing being in abutting contact with an outer surface of the casing of said hoisting machine.

5. The hoisting machine of claim 1, wherein said regenerative braking resistor is disposed such that a longitudinal direction of concave grooves constituting the concave-convex corrugated configuration of the corrugated metal plate of said resistor casing is a vertical direction.

* * * * *